United States Patent [19]

Beale

[11] 4,412,418

[45] * Nov. 1, 1983

[54] HYDRODYNAMIC LUBRICATION SYSTEM FOR PISTON DEVICES PARTICULARLY STIRLING ENGINES

[75] Inventor: William T. Beale, Athens, Ohio

[73] Assignee: Sunpower, Inc., Athens, Ohio

[ * ] Notice: The portion of the term of this patent subsequent to May 25, 1999, has been disclaimed.

[21] Appl. No.: 265,030

[22] Filed: May 18, 1981

Related U.S. Application Data

[63] Continuation-in-part of Ser. No. 97,409, Nov. 26, 1979, Pat. No. 4,330,993.

[51] Int. Cl.[3] ..... F02G 1/04

[52] U.S. Cl. ..... 60/520; 92/173

[58] Field of Search ..... 60/520, 517; 92/153, 92/173, 86.5, DIG. 2

[56] References Cited

U.S. PATENT DOCUMENTS

| | | | |
|---|---|---|---|
| 2,995,122 | 8/1961 | Randall | 92/173 X |
| 3,828,558 | 8/1974 | Beale | 60/520 |
| 4,330,993 | 5/1982 | Beale | 60/520 |

*Primary Examiner*—Allen M. Ostrager
*Attorney, Agent, or Firm*—Frank H. Foster

[57] ABSTRACT

An apparatus for effecting the lubrication of expansible chamber devices of the type having a cylinder with a piston reciprocating therein and having fluid flowing in and out of the chamber. The invention is particularly suitable for free piston Stirling engines and pumps. A torque force is applied to the piston causing it to spin sufficiently to entrain and drag along its outer surface some of the fluid in the expansible chamber so as to separate its outer surface from the wall of the cylinder.

21 Claims, 17 Drawing Figures

HYDRODYNAMIC LUBRICATION SYSTEM FOR PISTON DEVICES PARTICULARLY STIRLING ENGINES

BACKGROUND OF THE INVENTION

This is a continuation in part of my co-pending application, Ser. No. 0.6/097,409, filed Nov. 26, 1979, now U.S. Pat. No. 4,330,993.

TECHNICAL FIELD

This invention relates to apparatus and a method for the lubrication of expansible chamber devices of the type having a cylinder with a piston reciprocating therein and a fluid flowing in and out of the chamber. The apparatus and method of the present invention is particularly useful for lubricating the displacer piston, the power piston or both in a free piston Stirling engine.

One major advantage of the free piston Stirling engine is that the working gas can be entirely sealed within the engine to prevent its contamination or loss by leakage. It is undesirable to lubricate the pistons of the free piston Stirling engine with traditional lubricants, such as petroleum based oil and grease, because such lubricants vaporize into the working gas and reduce its efficiency.

Nonetheless, it is still desirable to lubricate such engines for the purpose of extending the life of the engine and reducing its wear and maintenance.

It is therefore an object of the present invention to effect the hydrodynamic lubrication of pistons through use of the fluids which act upon or are acted upon by the pistons in the operation of the device, and particularly to lubricate the pistons of Stirling engines with the working gas of the engine.

BRIEF DISCLOSURE OF THE INVENTION

In the present invention a torque force is applied to the piston to cause it to spin at a sufficient angular velocity that it will entrain and drag along its outer surface some of the fluid which acts upon or is acted upon by the piston. This layer of fluid separates the interfacing and relatively sliding surfaces of the piston and its associated cylinder.

In particular, the torque is applied by creating a turbine effect during the intake or exhaust of the fluid. The torque is applied to the piston by impinging a flowing stream of the fluid on the piston as the fluid enters or leaves the expansible chamber in a manner which creates a turbine effect urging the piston to spin.

Desirably, inlet or outlet ports are formed through the cylinder about the piston or pistons. Turbine surfaces, such as blades or the walls of slots are formed in and spaced around the pistons. The ports are positioned so that during the normal operation of the device, the fluid will flow through the port and periodically impinge upon the turbine surfaces to apply a circumferential force component on the piston. By selected positioning of the ports in many devices, such as the free piston Stirling engine, the normal operation of the device may be maintained undisturbed while gaining the advantages of hydrodynamic lubrication in accordance with the present invention.

DETAILED DESCRIPTION

Figure 1:
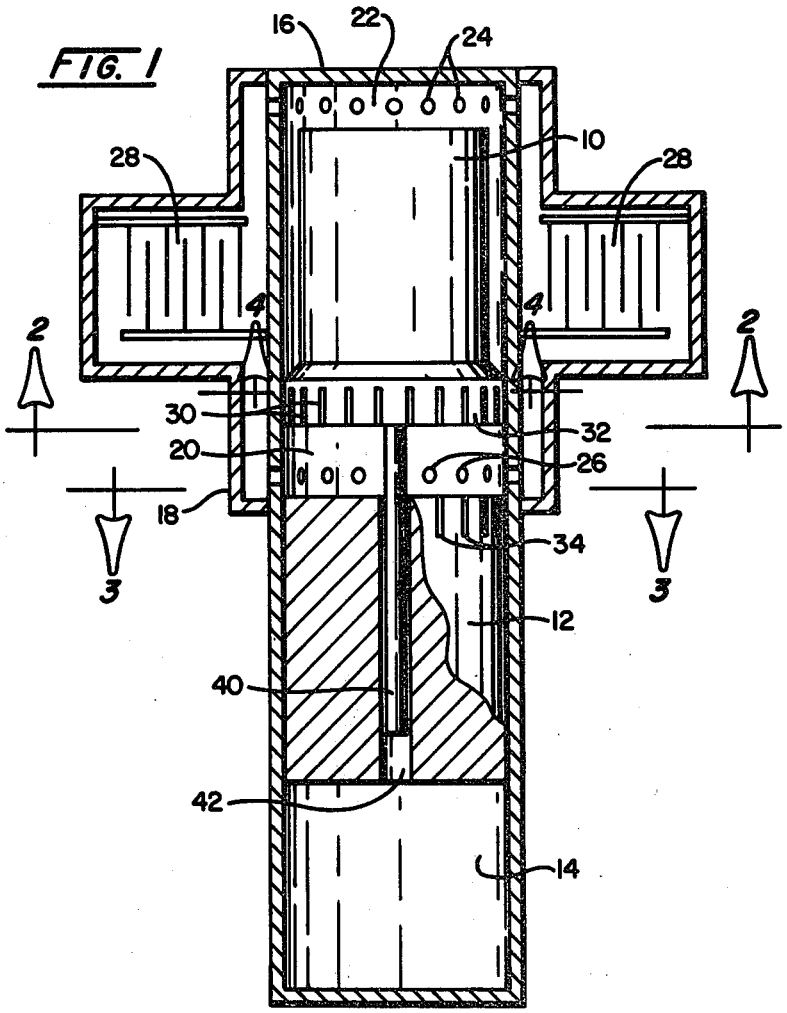
FIG. 1 is a diagrammatic view in axial cross section illustrating a free piston Stirling engine which embodies the invention.
Figure 2:
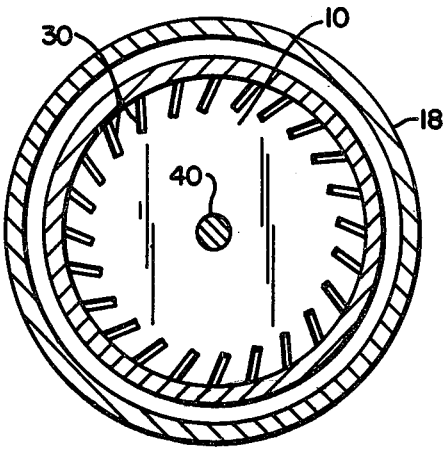
FIG. 2 is a bottom view of the displacer piston illustrated in the embodiment of FIG. 1.
Figure 3:
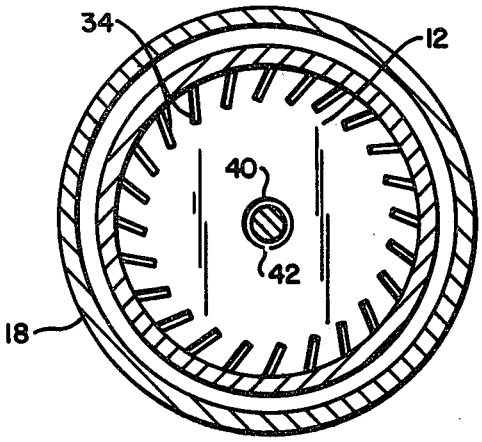
FIG. 3 is a top view of the power piston illustrated in the embodiment of FIG. 1.

FIG. 1 illustrates a free piston Stirling engine having a displacer piston 10 and a power piston 12 which reciprocate in a single, cooperating cylinder 14.

In the illustrated engine, heat is applied at its end 16 and withdrawn from its intermediate area 18. Therefore, the engine has its compression space 20 adjacent its cooled area 18 and its expansion space 22 adjacent its heated end 16, these spaces being formed at opposite ends of the displacer 10. The engine is provided with expansion space ports 24 which are in fluid communication with the expansion space 22 and compression space ports 26 which are in fluid communication with the compression space 20. These ports 24 and 26 are in communication with each other through a conventional regenerator 28.

The engine operates in the conventional manner as well known in the art. A working gas is contained within the expansion and compression spaces and is alternately forced into the heated expansion space 22 and the cooled compression space 20 by the displacer. The alternate heating and cooling of the working gas causes the gas to alternately expand and increase its pressure and contract and decrease its pressure. These alternate changes in pressure cause the power piston to reciprocate and also result in proper phasing of the reciprocating displacer piston. Since the fundamental operation of the free piston Stirling engine is well described in the prior art no further description is necessary here.

A plurality of inwardly extending slots 30 are arranged around the seal skirt portion 32 of the displacer piston. Similarly, a plurality of such slots 34 are arranged around the power piston 12. The inner walls of these slots form turbine surfaces against which working gas can be impinged as it flows between the compression and expansion spaces to create a turbine effect and a resulting torque on these pistons.

In the embodiment illustrated in FIG. 1 the compression space ports 26 are positioned to register with the slots 30 of the displacer piston 10 during the end of the stroke of the displacer piston 10 which is nearest or proximal to the compression space 20 and also to register with the slots 34 of the power piston at the end of its stroke which is nearest or proximal to the compression space 20.

The compression space ports 26 are positioned to direct the flowing stream of working gas upon the turbine surfaces in the slots of the pistons to impart an average torque in one direction upon the piston. As described below, the cyclical reciprocation of both pistons is such that their slots register with the ports 26 during a part of the cycle that the gas is flowing in a single direction. For example, in the embodiment illustrated, the gas impinges upon the slots 30 of the displacer piston 10 at a time in the cycle when gas is entering the compression space 20 and impinges upon the slots 34 of the power piston 12 at a time when the working gas is leaving the compression space 20 and flowing into the expansion space 22. During the registration of the slot walls of either piston with the ports, the flowing gas applies an impulse torque to the piston.

Figure 6:
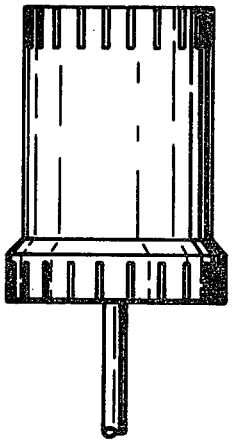
FIG. 6 is a side view of an alternative displacer piston structure embodying the present invention.
Figure 4:
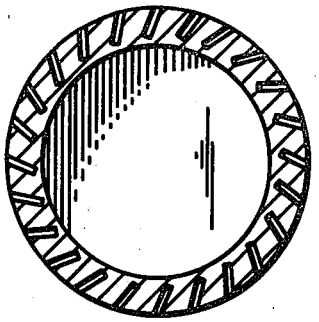
FIG. 4 is a view in cross section of an alternative embodiment of the ports in the cylinder wall illustrating an oblique port orientation.

Alternatively, the displacer turbine slots may be formed at the opposite end of the displacer piston to be impinged upon by working fluid flowing into the expansion space 22. As a still further alternative, the slots may be provided at both ends of the displacer piston 10 as illustrated in FIG. 6.

The structural configuration and orientation of the ports as well as of the turbine surfaces may be modified in a great variety of ways as is well known in the turbine art. For example, the slots may be curved and/or the inlet ports may be obliquely inclined to the cylindrical wall surface in order to impact a tangential component to the fluid flow. The various alternative turbine systems are not discussed in more detail because they are well discussed in the prior turbine art.

Furthermore, the turbine surfaces may be formed on a separate structure which is attached to the piston or the piston rod. However, for purposes of this patent, because such systems are functionally equivalent to being a part of the piston, they are considered to be a part of the piston.

As a further alternative, the ports may be positioned at the end wall or walls of the chamber of a reciprocating piston, expansible chamber device and provided with suitable cooperating turbine surfaces on the piston so that the fluid flow will apply the appropriate torque force to the piston during intake or exhaust of the fluid.

As still a further alternative the ports at the walls of the cylinder may be interposed between the extremes of the piston stroke. It is not necessary that they be positioned so that all flow be in a single direction during the interval that the turbine surfaces are in registration with the fluid ports. It is only necessary that during the interval of registration there be a net or average flow in one direction or the other.

As still another alternative, the ports or the turbine surfaces may additionally have some axial spacing rather than being arranged circularly at spaced intervals. For example, the ports may be somewhat helically arranged about the cylinder to provide a broader torque impulse of longer duration.

In the embodiment of FIG. 1 it is desirable to cause the displacer piston 10 and the power piston 12 to spin in opposite direction to assure that their interfacing portions, namely the piston rod 40 and its reciprocally associated bore 42, will be rotating relative to each other. This will assure that these interfacing surfaces are also lubricated. Of course, the two could be spun in the same direction at different speeds but with less effectiveness.

To accomplish this in the embodiment illustrated in FIG. 1, the slots 30 and the slots 34 may be formed in the same direction in the operable position which will provide opposite spin torques because the working gas flows into the compression space 20 when it impinges upon the turbine surfaces 32 of the displacer piston 10 and flows out of the compression space 20 when it impinges upon the turbine surfaces 34 of the power piston 12.

The advantages of the system of the present invention wherein a fluid, which acts upon, or is acted upon a piston, is directed to cause a turbine effect which in turn imparts a spin to lubricate the piston hydrodynamically are not limited to the coaxial free piston Stirling engines.

For example, it is applicable to free piston Stirling engines in which the displacer piston and the power piston reciprocate in different cylinders. Further, it is applicable to the broader range of expansible chamber devices which have a piston which both reciprocates and is free to rotate about its axis. For example, many such piston devices have a piston which is connected by an intermediate piston or connecting rod to a crankshaft. The addition of a suitable bearing on the piston rod in such a device will enable its piston to be free for rotation in addition to reciprocation. Thus, the principles of the present invention are applicable to other engines, pumps and motors of the expansible chamber, reciprocating piston type.

Figure 5:
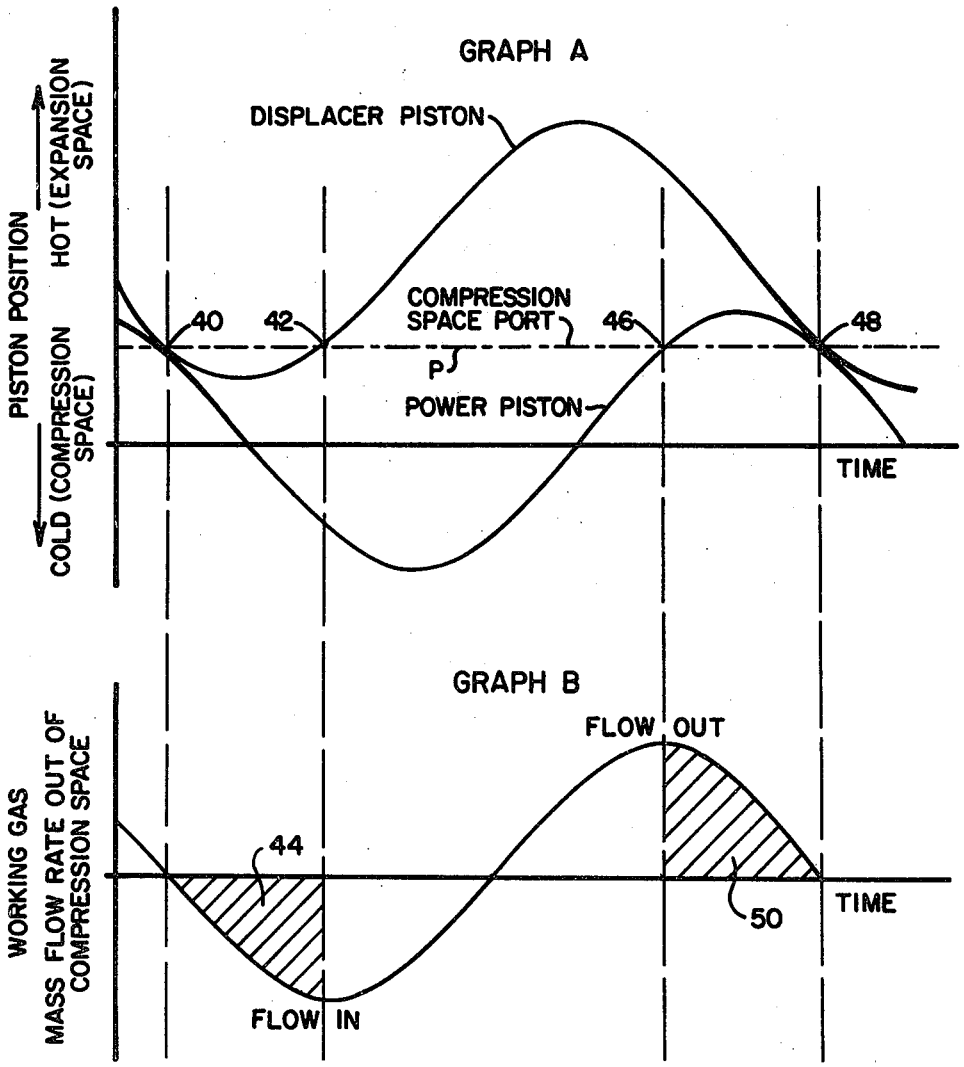
FIG. 5 is a graph illustrating the operation of the preferred embodiment of the invention.

FIG. 5 illustrates the operation of the embodiment of the invention illustrated in FIG. 1. Graph A of FIG. 5 is a plot representing the position of the opposing faces of the displacer piston and the power piston within the cylinder 14 as a function of time. The horizontal line P represents the position in the cylinder of the compression space ports 26. Of course, in a more detailed graph the horizontal line P actually would consist of a pair of parallel horizontal lines separated by a distance representing the width of the ports. In Graph A the more positive direction on the vertical axis represents positions nearer the hot or expansion space 22.

Whenever the displacer piston face is more negative than the horizontal line P or whenever the power piston face is more positive than the horizontal line P, the slots in the respective pistons are in registration with the compression space ports 26.

Graph B is a plot of the flow rate of the working gas with respect to time.

At point 40 in Graph A the displacer piston slots begin registration with the compression space ports 26. This registration continues until point 42. Therefore, during the time interval from points 40 to 42 a torque impulse is applied to the displacer piston by the gas which is flowing into the compression space and illustrated in the shaded area 44.

Similarly, during the time interval from point 46 to point 48 the power piston receives a torque impulse from the working gas flow illustrated in the shaded area 50.

Figure 7:
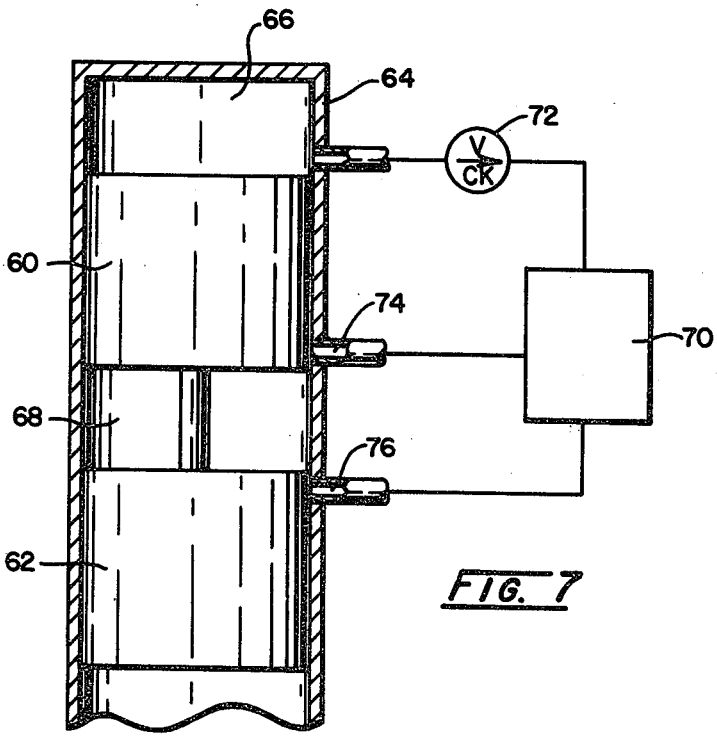
FIG. 7 is a diagrammatic illustration of an alternative embodiment of the invention.

FIG. 7 diagrammatically illustrates an alternative embodiment of the invention for use in a free piston Stirling engine in which the flowing stream of working fluid which impinges upon the turbine surfaces to impart the torque is obtained from a structure which is different from the conventional gas flow path between the hot space and the cold space. The diagram only illustrates the structures relevant to this modification and does not repeat many of the structures which are illustrated in FIG. 1.

The embodiment of FIG. 7 has a hot space 66, a cold space 68, a power piston 62 and a displacer piston 60 mounted within the cylinder 64 in the same manner as the device of FIG. 1.

However, the structure illustrated in FIG. 7 additionally is provided with a storage chamber 70 which is in communication with a port 73 or several such ports through a check valve 72. The storage chamber is also in communication with ports 74 and 76. A plurality of annularly arranged ports may be substituted for ports 74 and 76.

Whenever the port 73 is exposed by the displacer 60 and the working gas pressure in the work space is greater than the gas pressure in the storage chamber 70, working gas will flow into the storage chamber. Thus, gas flows during the high pressure part of the operating cycle into the storage chamber 70 through the check valve 72.

The ports 74 and 76 are positioned so that they will be in registration with the turbine surfaces during a relatively low pressure portion of the operating cycle. Thus, when such registration occurs, gas can flow from the storage chamber and impinge upon the turbine surfaces to impart a torque upon the pistons in a manner similar to that described above. In this manner the storage chamber 70 accumulates working fluid during the high pressure portion of the operating cycle and releases it to flow against the turbine surfaces during the lower pressure portions of the cycle.

FURTHER IMPROVEMENTS AND EMBODIMENTS

In addition to the above described embodiments of the invention, there are additional means for applying a torque to one or both pistons to induce its spin. These various systems can be used to induce a spin in one or in both pistons. A second group of systems involves the coupling of a first piston which is induced by some other means to spin, to a second piston and using the coupling system to induce the spin in the second piston. Thus, there are various means for inducing at least one piston to spin which can be used to induce both pistons to spin or alternatively a means can be used to induce one piston to spin and the spinning of the first piston can be used to drive the second piston in its spin.

Figure 8:
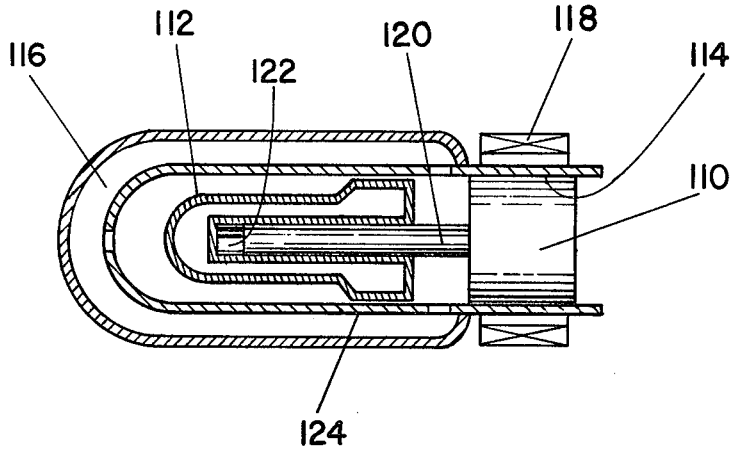
FIG. 8 is a diagrammatic illustration in section of an alternative embodiment of the invention.

FIG. 8 illustrates a means for inducing a spin in one of the pistons. FIG. 8 shows a power piston 110 and a displacer 112 which reciprocate in cooperating cylinders 114 and 116 respectively. An electrical winding 118 is wound about the cylinder 114 exteriorly of the power piston 110. The winding is of the same type used in an electrical motor which creates a rotating electromagnetic field. The wall of the cylinder 114 is formed of a non-ferromagnetic material so that the rotating electromagnetic field may act upon the power piston 110. The power piston 110 may also be provided with motor type windings such as used in a synchronous motor or may be electrically constructed like the rotor of an induction motor so that the rotating electromagnetic field will induce a rotating motor in the power piston 110.

Other motor systems may be used to drive a piston in its spin although mechanical linkages would reduce the efficiency of the Stirling engine.

The power piston 110 has a piston rod 120 which extends into a mating bore 122 formed in the displacer 112. A gas spring is formed in the space at the end of the piston rod 120. This illustrates one of several types of means for drivingly linking one of the pistons to the other piston in a manner to apply a torque to and spin the second piston. In particular this illustrates a means for linking a spinning power piston 110 to the displacer 112 for causing the displacer to also spin.

The spinning of the piston rod 120 will exert a shear force through the thin fluid film across the interface from the outer surface of the piston rod 20 to the inner wall of the bore 122.

Similarly, a fluid film will exist between the seal region 124 of the displacer 112 and the cylinder wall 116 in which it reciprocates. The seal region film will dynamically apply a shear force opposite to the driving torque and create a drag which retards the rotation of the displacer 112.

Thus, as the rotation of the displacer accelerates, the shear force at the seal region will become greater and the shear force applied by the piston rod will become less. An equilibrium will be reached at which the displacer is spinning at an intermediate angular velocity greater than zero and less than the angular velocity of the spinning power piston 110. Consequently, there will be hydrodynamic lubrication between the relatively moving surfaces of the cylinder 116 and the seal region 124 as well as between the relatively moving surfaces between the piston rod 120 and the bore 122.

Figure 9:
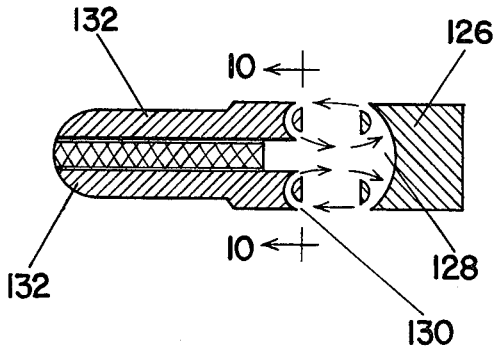
FIG. 9 is a diagrammatic illustration of an alternative embodiment of the invention showing only the power piston and displacer.

Thus, FIG. 8 illustrates one fluid coupling means by which one spinning piston is used to induce the spin in the second piston. FIG. 9 illustrates yet another fluid coupling means for inducing the spin of the second piston.

FIG. 9 illustrates the formation of a fluid pump upon one piston and the formation of a fluid motor on the other piston in communication with the fluid pump so that the moving fluid which is pumped by the first piston induces the spin in the second piston.

Referring in more detail to FIG. 9, the power piston 126 may be induced to spin by any of the systems described in this patent.

Figure 10:
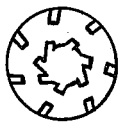
FIG. 10 is an end view in section taken along the line 10—10 of FIG. 9.

A radial outflow pump is formed in the end of the power piston 126 by passageways 128 so that fluid is propelled outwardly as shown by the arrows in FIG. 9 by the centrifugal force from the spinning of power piston 126. A radial inflow motor, such as a turbine system, is formed by passageways 130 at the opposing end of the displacer 132. FIG. 10 illustrates an end view in section of the passageways formed at the end of displacer 132.

The fluid, such as the working gas, is forced to circulate as illustrates and because of the inclined nature of the passageways in the piston 134 and displacer 132, will apply a force component which induces a spin in the displacer 132 in accordance with well known turbine technology. Although the distance between the displacer and the power piston varies during each cycle, a net torque will be applied although varying in intensity throughout the cycle. The engine of FIG. 9 is shown with a regenerative displacer which has the regenerator 132 formed in the interior of the displacer as is known in the prior art.

Figure 11:
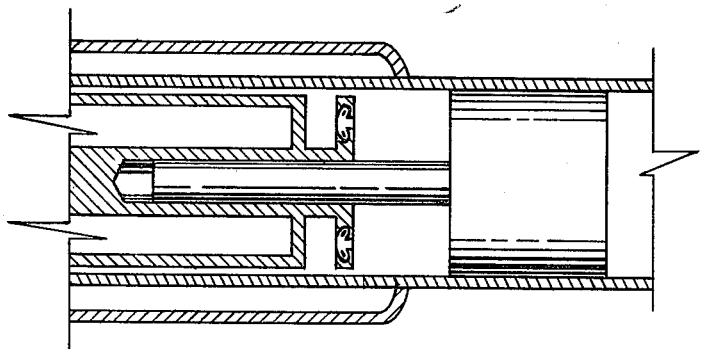
FIG. 11 is a diagrammatic illustration in section illustrating an alternative embodiment of the invention utilizing fluidic diodes.

FIG. 11 shows a displacer having a plurality of two-way flow fluidic diodes circularly spaced about a skirt extending from the displacer. The fluidic diodes provide another system for driving one or both pistons. As is known in the prior art, a fluidic diode is a device which has more flow resistance in one direction than in the opposite direction. By angularly aligning the fluidic diodes in the manner of turbine surfaces, the flow in one direction will apply a greater torque than the flow in the opposite direction. The fluidic diodes are positioned so that they extend into the fluid flow path within the cylinder so that fluid will be caused to flow through them in opposite directions during opposite strokes of the displacer. The greater torque during one stroke than during the other will cause a net resultant torque to be applied to the displacer causing it to spin.

Figure 12:
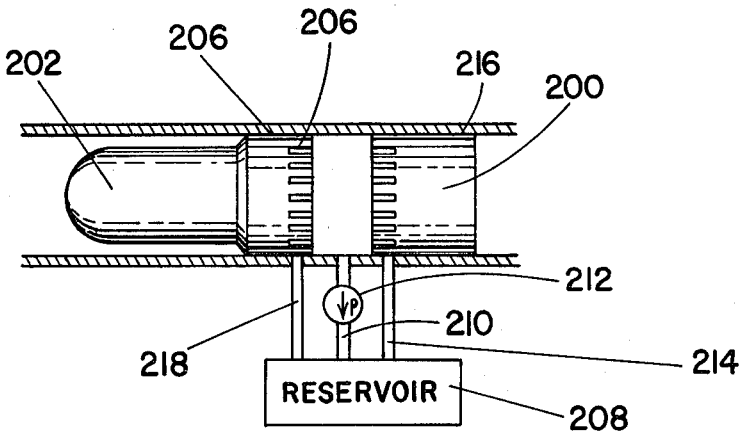
FIG. 12 is a diagrammatic illustration of an alternative embodiment of the invention utilizing a separate gas fluid reservoir.

Yet another structure for inducing the spin in one or both of the pistons is illustrated in FIG. 12. It is somewhat similar in the structure illustrated in FIG. 7.

Referring to FIG. 12, a power piston 200 and displacer 202 are formed with turbine surfaces 204 and 206 respectively in the same manner as the turbine surfaces described in connection with FIGS. 1 through 7. A separate reservoir 208 is connected to an inlet 210 to permit the entry of fluid into the reservoir 208. The fluid may be forced into the reservoir 208 either by a pump 212 as illustrated in FIG. 12 or fluid pressure operating upon a check valve or similar structure as illustrated in FIG. 7. At least one fluid outlet, such as fluid outlet 214, connects the reservoir to the cylinder wall 216 with the outlet positioned and formed to direct a flowing stream of fluid to impinge upon the turbine surfaces and impart an average torque upon the power piston 200 causing it to spin in the manner described above. A second outlet 218 may also be provided for applying a torque upon the displacer 202.

Thus, fluid may be pumped into the reservoir by a pump mechanism which may be mechanically connected to the output of the Stirling engine or to another driving source and passes through control valves or through outlets 214 and 218 of appropriate size to impinge upon the turbine surfaces and induce the required spin.

Figure 17:
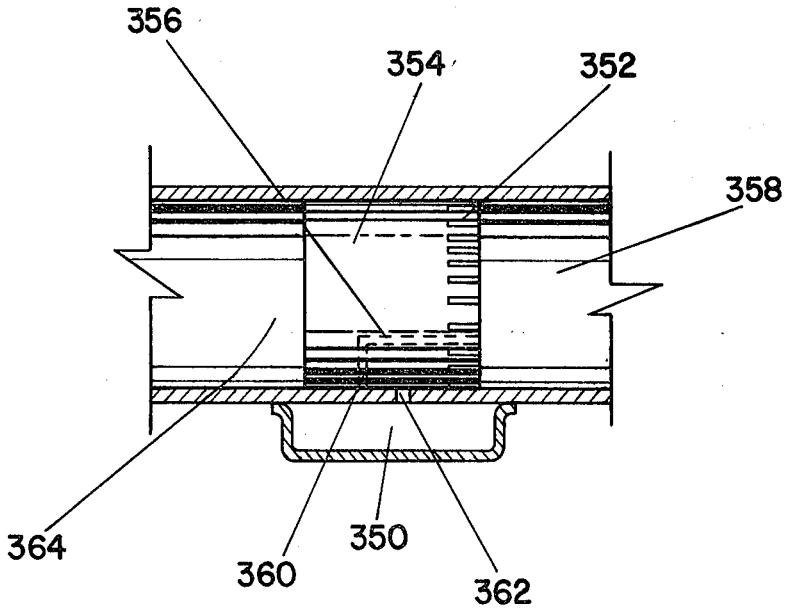
FIG. 17 is a diagrammatic illustration of yet another embodiment for utilizing a separate reservoir for temporarily storing gas.

FIG. 17 illustrates yet another embodiment of the invention in which a separate reservoir 350 is used to temporarily store gases and to release them to impinge upon the turbine surfaces 352 to effect the piston spin. The piston 354 is provided with a passageway 356 communicating between the bounce space 358 and a port 360 formed on the outer periphery of the piston 354.

A cooperating port 362 is provided in the cylinder wall 364 so that when the port 360 and the port 362 are in registration, gas may pass between the bounce space 358 and the reservoir 350. The ports are positioned so that they are in registration when the bounce space 358 is at a relatively high pressure. Thus, the ports are aligned when the piston 354 is at the extreme of its reciprocating path. Since the bounce space will be under a relatively high pressure, gas will pass into the reservoir 350.

As the piston moves away from the bounce space 358, the port 360 is sealed and the pressure in the bounce space 358 is significantly reduced.

Eventually the turbine surfaces 358 will be in alignment with the port 362 and the higher pressure gas in the reservoir 350 will be expelled under force of its higher pressure against the turbine surfaces to induce a spin in the piston.

For some embodiments of the invention it may be desirable to limit or regulate the angular velocity of the spin of a piston. This may be done by providing a structure on the spinning piston which forms a drag means for exerting a dynamic counter torque upon the piston in order to regulate its angular velocity. FIGS. 13 through 16 illustrate such a structure forming a centrifugal brake.

Figure 13:
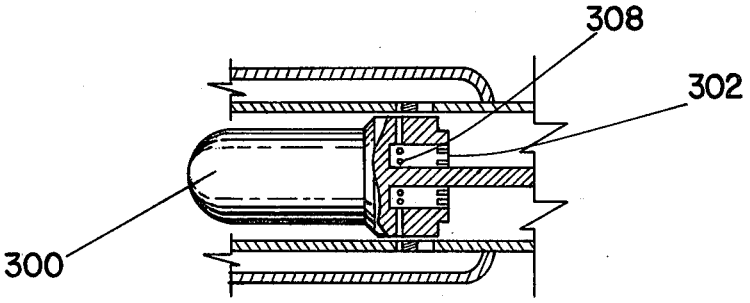
FIG. 13 is a diagrammatic illustration in section illustrating another alternative embodiment of the invention.
Figure 14:
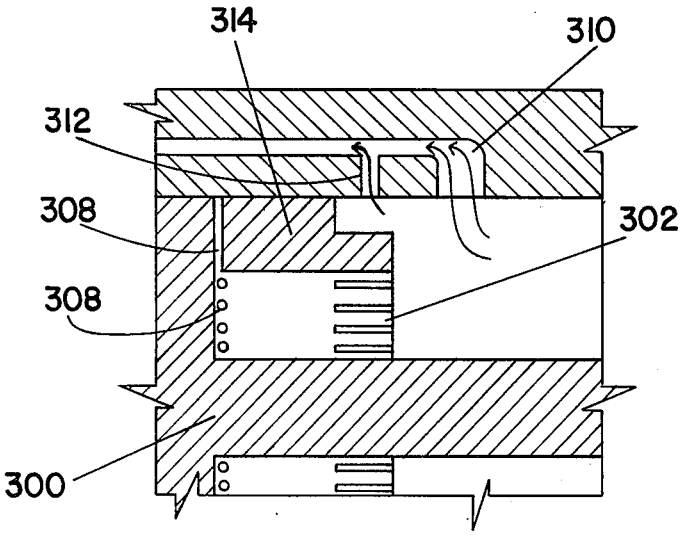
FIG. 14 is a diagrammatic illustration in section of a segment of the embodiment of FIG. 13.
Figure 15:
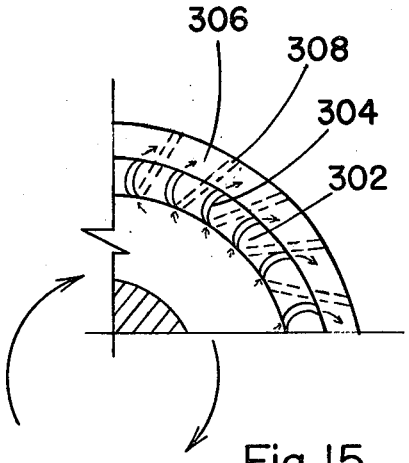
FIG. 15 is an end view of a quarter segment of the displacer of the embodiment illustrated in FIG. 14.
Figure 16:
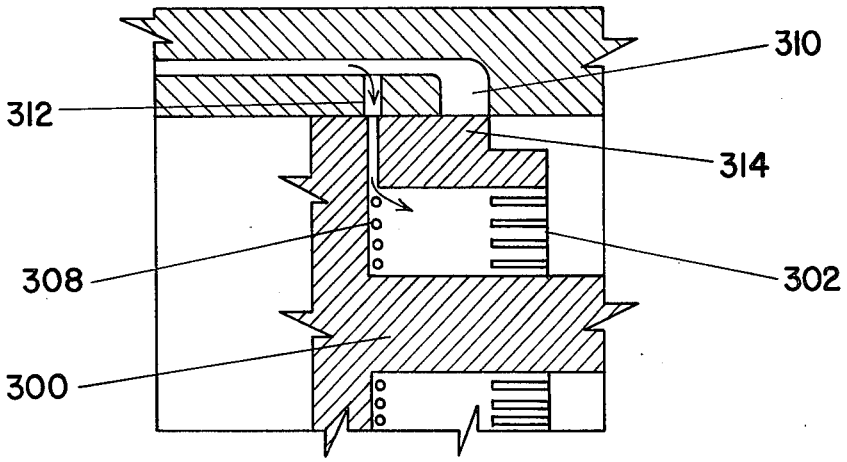
FIG. 16 is a diagrammatic illustration of the embodiment of FIG. 14 with the displacer in a different position for illustrating the operation of that embodiment.

The centrifugal brake illustrated in FIG. 13 is a fan type structure 302 constructed in the manner of a squirrel cage fan. The squirrel cage type fan 302 is illustrated most clearly in FIG. 15. It is formed by a plurality of annularly arranged slots 304 separated by a solid structure 306 which may be termed fan blades although an alternative fluid impeller could be formed on the piston. The slots 304 are arched so that with the piston spinning in a clockwise direction in FIG. 15, fluid is forced inwardly through the slot and deflected in a manner to retard the spin. Thus, a countertorque is induced as a result of the change of direction of the fluid flowing through the slot. Variation in the number, size, spacing and geometrical configuration of the slots varies the drag or countertorque applied to the spinning pistons.

Such a drag means will apply a retarding force only under dynamic spinning conditions. Under starting conditions when there is no spinning no retarding force is applied. The retarding force increases as angular velocity increases until the spin inducing torque comes to equilibrium with the drag torque.

FIGS. 13 through 16 additionally illustrate yet another alternative structure for improved inducement of the spin in the piston. FIGS. 13 through 16 show a displacer 300 which has its turbine surfaces formed as a plurality of angularly spaced passageways 308. These passageways are angled as described in connection with FIGS. 1 through 7.

However, the working gas port is bifuricated in that it comprises spaced intercommunicating ports 310 and 312.

However, the port 310 through the wall of the cylinder is periodically blocked by a portion 314 of the displacer 300.

The port 312 is positioned so that during the interval of the stroke at which the port 310 is blocked, the turbine surfaces are positioned in registration with the port 312 so that the flowing gas stream is directed entirely through the turbine passageways 308 and against the turbine surfaces.

This is provided at the end of the stroke of the displacer. Because the displacer leads the power piston by approximately 90°, when the displacer is at the end of its stroke the power piston is at an intermediate position in its stroke and at its maximum linear velocity. During the maximum velocity of the power piston, the gas flow rate from one space of the Stirling engine to the other is at its maximum flow rate. Consequently the displacer will receive a sharp torque impulse at the end of its stroke, preferably for approximately 45°.

I claim:

1. An improved Stirling engine of the type having a displacer piston and a power piston which reciprocate in cooperating cylinders confining a working fluid, said improvement being for hydrodynamically lubricating said pistons and comprising:

(a) means for spinning a first one of said pistons about its axis; and (b) means for drivingly linking said first piston to said second piston to apply a torque to and spin said second piston.

2. An apparatus in accordance with claim 1 wherein said drivingly linking means comprises a fluid coupling means.

3. An apparatus in accordance with claim 2 wherein said fluid coupling means comprises an axially aligned shaft extending from one of said pistons through a bore formed in the other of said pistons with a sufficiently small clearance to exert a shear force across the interface between said shaft and said bore to apply a torque to said second piston.

4. An apparatus in accordance with claim 2 wherein said linking means comprises a fluid pump connected to said first piston and a fluid motor in fluid communication therewith connected to said second piston.

5. An apparatus in accordance with claim 4 wherein said fluid pump comprises a radial outflow pump and said motor comprises a radial inflow turbine.

6. An apparatus in accordance with claim 5 wherein said Stirling engine has a regenerative displacer in fluid communication with said radial inflow turbine.

7. In a Stirling engine of the type having a displacer piston and power piston which reciprocate in cooperating cylinders confining a working fluid, hydrodynamic lubrication means comprising:

(a) a plurality of turbine surfaces formed on and arranged around at least a first one of said pistons; and (b) a reservoir having an inlet for receiving a portion of said fluid and having at least one outlet positioned and formed to direct a flowing stream of said fluid to impinge upon said turbine surfaces to impart an average torque upon said first piston for causing said piston to rotate about its axis and entrain some of said fluid about its outer surface.

8. An apparatus in accordance with claim 7 said inlet has a check valve which admits fluid at a pressure above a selected level.

9. An apparatus in accordance with claim 7 wherein said inlet has a fluid pump for pumping fluid into said reservoir.

10. An apparatus for hydrodynamically lubricating a piston which reciprocates in a cylinder, said apparatus comprising:

(a) means for applying a torque to said piston and inducing it to spin; and (b) drag means for exerting a dynamic counter torque upon said piston for regulating the angular velocity of said spinning piston.

11. An apparatus in accordance with claim 10 wherein said drag means comprises a centrifugal brake.

12. An apparatus in accordance with claim 10 wherein said drag means comprises a fluid impeller formed at an end of said piston.

13. In an expansible chamber device of the type having at least one cylinder with a piston mounted therein to permit its reciprocation and rotation about its axis, a fluid which at times flows into a portion of said cylinder and at times flows out of said cylinder, and fluid port means for intake and exhaust of said fluid, a plurality of turbine surfaces formed on and arranged around said piston; and at least one fluid port of said port means opening into said cylinder and positioned and formed to direct a flowing stream of said fluid to impinge upon said surfaces to impart an average torque upon said piston for causing said piston to rotate about its axis and entrain some of said fluid about its outer surface for hydrodynamic lubrication, the improvement comprising:

a port means having a bifurcated port comprisinhg spaced intercommunicating openings, a first one of said openings formed in the wall of said cylinder in a position for periodically being blocked by a portion of said piston during an interval of its stroke, the second one of said spaced openings being said port which directs said flowing stream of fluid upon said turbine surfaces and positioned to direct said stream when said first opening is blocked.

14. A method for lubricating a piston of a free piston Stirling engine said method comprising applying a torque force to said piston causing it to spin sufficiently to entrain and drag along its outer surface some of the working fluid of the engine to separate its outer surface from the wall of said cylinder.

15. A method in accordance with claim 14 wherein said torque is applied by impinging a flowing stream of said working fluid upon said piston to create a turbine effect.

16. A method in accordance with claim 15 wherein said stream is a portion of the working fluid in transit between the hot space and the cold space of said engine.

17. A method in accordance with claim 15 wherein some of said working gas is compressed into a chamber from and during a high pressure portion of the engine cycle and is subsequently released to form said impinging stream.

18. An improved Stirling engine of the type having a displacer piston and a power piston which reciprocate in cooperating cylinders confining a working fluid, wherein the improvement comprises a rotating motor drivingly linked to at least one of said pistons to apply a torque force to said piston causing it to spin sufficiently to entrain and drag along its outer surface some of said fluid to separate its outer surface from the wall of its cooperating cylinder.

19. An apparatus in accordance with claim 18 wherein said motor comprises a motor of the rotating electromagnetic field type.

20. An improved Stirling engine of the type having a displacer piston and a power piston which reciprocate in cooperating cylinders confining a working fluid, wherein the improvement comprises at least one fluidic diode mounted to at least one of said pistons and extending into a fluid flow path within one of said cylinders for applying a torque force to at least one of the pistons causing it to spin sufficiently to entrain and drag along its outer surface some of said fluid to separate its outer surface from the wall of said cylinder.

21. An improved Stirling engine in accordance with claim 9 wherein a plurality of fluidic diodes are annularly spaced around an end of said piston.

* * * * *